US011297995B2

(12) United States Patent
Weeks et al.

(10) Patent No.: US 11,297,995 B2
(45) Date of Patent: Apr. 12, 2022

(54) STEAM CLEANING APPLIANCE

(71) Applicant: SHARKNINJA OPERATING LLC, Needham, MA (US)

(72) Inventors: Alan L. Weeks, South Easton, MA (US); Kim C. Reeves, Lexington, TN (US); William Scott Hughes, Waltham, MA (US); Ognjen Vrdoljak, Laval (CA)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/658,673

(22) Filed: Oct. 21, 2019

(65) Prior Publication Data

US 2020/0046196 A1 Feb. 13, 2020

Related U.S. Application Data

(62) Division of application No. 14/439,990, filed as application No. PCT/US2013/071988 on Nov. 26, 2013, now Pat. No. 10,448,800.

(60) Provisional application No. 61/793,274, filed on Mar. 15, 2013, provisional application No. 61/771,623, filed on Mar. 1, 2013, provisional application No. 61/731,437, filed on Nov. 29, 2012.

(51) Int. Cl.
*A47L 13/22* (2006.01)

(52) U.S. Cl.
CPC ..... *A47L 13/225* (2013.01)

(58) Field of Classification Search
CPC ..... A47L 13/225; A47L 13/22
See application file for complete search history.

(56) References Cited

U.S. PATENT DOCUMENTS

| | | | | |
|---|---|---|---|---|
| 774,894 | A | 11/1904 | Roberts | |
| 5,613,271 | A | 3/1997 | Thomas | |
| 5,888,006 | A | 3/1999 | Ping et al. | |
| 7,891,047 | B2 | 2/2011 | Milanese | |
| 7,930,798 | B2 * | 4/2011 | Zhou | A47L 13/22 15/320 |
| 2006/0000049 | A1 | 1/2006 | Rosenzweig | |
| 2008/0189900 | A1 | 8/2008 | Milanese | |

(Continued)

FOREIGN PATENT DOCUMENTS

| | | | |
|---|---|---|---|
| CN | 201542570 U | | 8/2010 |
| CN | 203089005 U | * | 7/2013 |

(Continued)

OTHER PUBLICATIONS

Machine translation of CN203089005U (Year: 2013).*

(Continued)

*Primary Examiner* — Douglas Lee
(74) *Attorney, Agent, or Firm* — Grossman Tucker Perreault & Pfleger, PLLC

(57) ABSTRACT

Embodiments of the invention disclosed herein include steam appliances and methods which apply steam and a liquid containing a cleaning agent to the floor via separate outlets. In some embodiments, the liquid containing a cleaning agent is applied to an area of the floor that is physically separated from a steam application area. The steam may be applied to the floor through a steam-permeable fabric. The liquid containing a cleaning agent may be heated before being applied to the floor or being mixed with steam.

16 Claims, 17 Drawing Sheets

(56) References Cited

U.S. PATENT DOCUMENTS

| | | | | |
|---|---|---|---|---|
| 2010/0199455 | A1* | 8/2010 | Vrdoljak | A47L 5/24 15/320 |
| 2010/0251505 | A1* | 10/2010 | Vrdoljak | A47L 9/2805 15/320 |
| 2011/0236275 | A1* | 9/2011 | Robertson | A61L 2/07 422/291 |
| 2012/0042462 | A1* | 2/2012 | Milanese | A47L 13/225 15/104.93 |
| 2013/0125940 | A1* | 5/2013 | Morgan | A47L 11/4011 134/57 R |

FOREIGN PATENT DOCUMENTS

| | | | |
|---|---|---|---|
| EP | 652460 | A1 | 5/2006 |
| EP | 1654974 | A1 | 5/2006 |
| JP | 11104051 | A | 4/1999 |
| WO | 2008096950 | A1 | 8/2008 |

OTHER PUBLICATIONS

International Search Report and Written Opinion dated Apr. 28, 2014, received in PCT Application No. PCT/US13/71988.
International Preliminary Report on Patentability dated Jun. 11, 2015, received in PCT Application No. PCT/US13/71988.

* cited by examiner

STEAM CLEANING APPLIANCE

CROSS-REFERENCE TO RELATED APPLICATIONS

This application is a divisional of U.S. patent application Ser. No. 14/439,990, filed Apr. 30, 2015, which is a national stage filing under 35 U.S.C. 371 of international PCT Application No. PCT/US13/71988 filed Nov. 26, 2013, which claims the benefit of Provisional Application Ser. No. 61/731,437 filed Nov. 29, 2012, Provisional Application Ser. No. 61/771,623 filed Mar. 1, 2013, and Provisional Application Ser. No. 61/793,274 filed Mar. 15, 2013, each of which are fully incorporated herein by reference.

FIELD OF THE INVENTION

The invention relates generally to steam cleaning appliances, and more specifically to steam appliances that clean floors.

DISCUSSION OF THE RELATED ART

Steam cleaning appliances are used in the home to apply steam to floors for cleaning and sanitizing. Various types of steam appliances are known, including steam mops which apply steam to the floor and have an absorbent cleaning pad to collect dirt and other contaminants. Some steam mops apply steam to the floor through a steam-permeable cleaning pad.

SUMMARY

Figure 1:
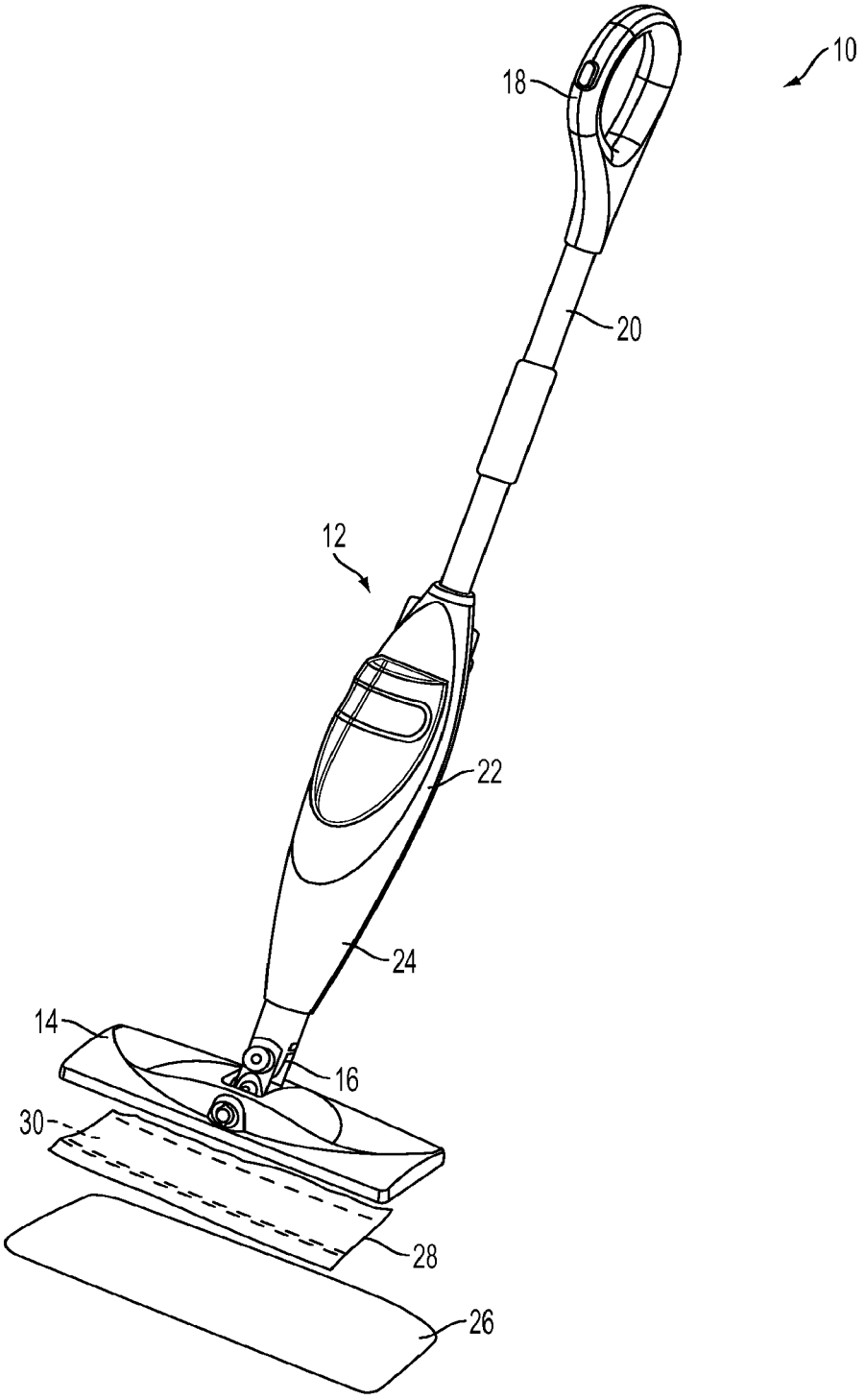
FIG. 1 is a perspective view of a steam cleaning appliance according to one embodiment of the invention.

According to one embodiment, a steam cleaning appliance for cleaning floors includes a cleaning head configured to attach a steam-permeable cleaning pad to contact a floor, an elongated appliance body attached to the cleaning head to maneuver the cleaning head on the floor, and a liquid applicator configured to apply a first liquid to the floor. The appliance further includes a steam source to generate steam from a second liquid, and a steam outlet in communication with the steam source and configured to apply steam to the floor through the cleaning pad, the steam outlet being separate from the liquid applicator.

According to another embodiment, a steam cleaning appliance for cleaning floors includes an appliance body, a handle attached to the appliance body, a liquid applicator to apply the first liquid to a floor, a steam source to generate steam, and a cleaning head to apply steam to the floor. Movement of the handle in a forward and/or backward motion to move the cleaning head on the floor operates a liquid delivery system to deliver the second liquid to the steam source. The appliance also includes a controller configured to prevent delivery of the second liquid to the steam source when the steam source is not generating steam.

According to a further embodiment, a method of cleaning a floor using a steam cleaning appliance includes (a) applying a liquid including a cleaning agent to an area of a floor using a liquid applicator disposed on a steam appliance, (b) applying steam to the area of the floor using the steam appliance by applying steam through a steam-permeable cleaning pad which is attached to the cleaning appliance after act (a) is complete, and (c) sliding the cleaning pad across the area of the floor.

According to yet another embodiment, a steam cleaning appliance for cleaning floors includes a cleaning head configured to attach a cleaning pad to contact a floor, an appliance body attached to the cleaning head to maneuver the cleaning head on the floor, a first reservoir to hold a first liquid containing a cleaning agent, a first conduit in communication with the first reservoir as part of a system to deliver the first liquid to the floor, a second reservoir to hold a second liquid, different from the first liquid, a steam source to generate steam from the second liquid, and a steam outlet in communication with the steam source and configured to apply steam to the floor. At least one of the first conduit and the first reservoir is arranged to receive heat, prior to any mixing with steam, from at least one of: the steam generating unit, steam ejected from the steam outlet, and a steam conduit carrying steam from the steam generating unit to the steam outlet.

DETAILED DESCRIPTION

Steam cleaning appliances such as steam mops are used to clean and sanitize floors and other household surfaces. Some known steam mops apply steam directly to an area of the floor and use a pad to scrub the same area of the floor, and/or collect contaminants, and/or absorb moisture. In some known steam mops, steam is applied to the floor through a steam-permeable pad which can be used to collect dirt and contaminants. In still further known steam mops, a cleaning agent is added to steam prior to applying the mixture directly to the floor.

Applicants have recognized that by separating the application of a cleaning agent and the application of steam, various advantages may be realized as compared to conventional steam mops. Embodiments of the invention disclosed herein include steam appliances and methods which apply steam and a liquid containing a cleaning agent to the floor via separate outlets. In some embodiments, the liquid containing a cleaning agent is applied to an area of the floor that is physically separated from a steam application area.

In some embodiments, this separation grants time for the cleaning solution to soak into a stain or a dried up food spill to loosen debris before the steam is applied and/or a cleaning pad is used to scrub the stain. In some cases, the user can spray a cleaning solution onto a stain, and then select how long to allow the solution to work into the stain before applying steam and/or scrubbing. By allowing the cleaning solution to soak into the stain or spill before further cleaning efforts, the overall cleaning time and/or effort can be reduced. The amount of cleaning solution to apply to the stain relative to the amount of steam to use also may be selected by the user in embodiments disclosed herein. For example, the user can spray as much cleaning solution as they wish on a stain before applying steam to the stain. Further, while many food-based stains are water soluble, other types of stains, e.g. scuff marks, may not be water soluble, and such stains may be easier to clean when using both steam and a cleaning solution.

Another advantage of embodiments disclosed herein is the ability to apply steam through a steam-permeable pad while still being able to use a cleaning solution or other cleaning agent. When a cleaning solution is added to a flow of steam and then passed through a steam-permeable pad, the pad may absorb significant amounts of the cleaning agent. This absorption can lead to a decreased effectiveness of the cleaning agent, and also may wet the pad which can be undesirable.

Further, various arrangements disclosed herein heat the cleaning solution prior to floor application without requiring initial mixing with steam. By heating the cleaning solution, the solution can work faster on breaking up a stain or spill, yet at the same time be permitted to soak into the stain before steam application and/or physical agitation begins. Additionally, in some cases a heated cleaning solution may be used without any application of steam. That is, the heated cleaning solution may be applied to the floor and then agitated and/or absorbed by the cleaning pad without the application of steam. The option to then use steam is still available to the user if he or she so decides.

In some embodiments, the cleaning solution may be heated above room temperature, for example, heated above room temperature by 3 degrees Fahrenheit, by 5 degrees Fahrenheit, by 10-12 degrees Fahrenheit, by 10-20 degrees Fahrenheit, by 20-50 degrees Fahrenheit, or by any other suitable amount. In some embodiments, the cleaning solution may be heated to a temperature of 90-100 degrees Fahrenheit, of 100-150 degrees Fahrenheit, or 150-200 degrees Fahrenheit. In some embodiments, the steam may be heated within 5-10 degrees of the temperature of the steam that is being used by the appliance, within 10-20 degrees of the temperature of the steam, or within 20-50 degrees of the temperature of the steam.

In some embodiments, the cleaning solution is routed through a conduit which is heated in one or more locations directly or indirectly by the steam. Accordingly, a separate heating system to pre-heat the cleaning solution is not required in some embodiments.

Turning now to the figures, FIG. 1 shows a steam cleaning appliance 10, which includes an elongated appliance body 12 attached to a cleaning head 14, such as a mop head, by a universal connector 16. The appliance body 12 includes a handle 18, a pole 20, and a housing 22 in some embodiments. Within the housing 22 is a steam generating unit 24, which sends steam to a steam-permeable pad 26 that is removably attachable to the cleaning head 14. In some embodiments, the pad may be a cleaning sheet that may be removably attached to the cleaning head 14. The cleaning sheet may be attached to the cleaning head by an attachment layer 30.

Figure 2:
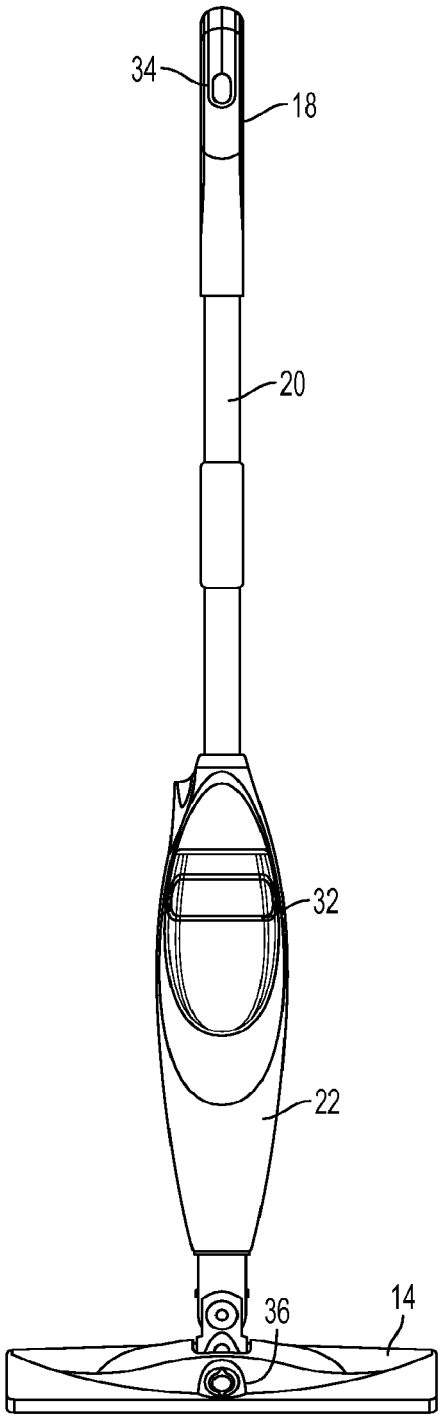
FIG. 2 is a front view of the steam cleaning appliance according to one embodiment of the invention.

As show in FIG. 2, the front side of the housing 22 may include a first liquid reservoir 32 which holds a first liquid, such as a cleaning solution. The cleaning solution may be a soap, sanitizing agent, disinfectant, encapsulant, or a combination thereof. The cleaning solution may also include a scent. In other embodiments, the first liquid reservoir may hold only water. Liquid reservoir 32 may be removable in some embodiments, and non-removable in other embodiments. In some embodiments, reservoir 32 may be filled with the first liquid or cleaning solution using a fill cup to pour into an opening.

To apply the cleaning solution to the floor, either individually or in combination with steam application, a user may press a spray button 34 located on the handle 18. Upon pressing the spray button 34, an electric pump expels the cleaning solution in the first liquid reservoir 32 through a first conduit and to a liquid applicator 36 located on the cleaning head 14. It should be appreciated that the liquid applicator 36 may apply only water in some embodiments. In other embodiments, the liquid applicator 36 may be located on the housing 22, on the universal connector 16, or at any other suitable location. In yet another embodiment, the cleaning head may include more than one liquid applicator 36. For example, a liquid applicator 36 may be located on each side of the cleaning head 14 or several liquid applicators may be located along the front edge of the cleaning head 14 or on the top of the cleaning head 14. Instead of an electric pump, a manual pump may be used to move liquid through the liquid applicator 36. For example, a trigger or push button may be included on the handle 18, and activation of the trigger or push button may operate a manual pump to push the liquid through a spray nozzle, a mister, a liquid outlet tube, or any other suitable liquid applicator.

In some embodiments, the application of steam and cleaning solution are individually controllable. Further, in some embodiments, the appliance has a mode where only cleaning solution can be applied to the floor. The appliance also may have a mode where only steam can be applied to the floor.

Figure 3:
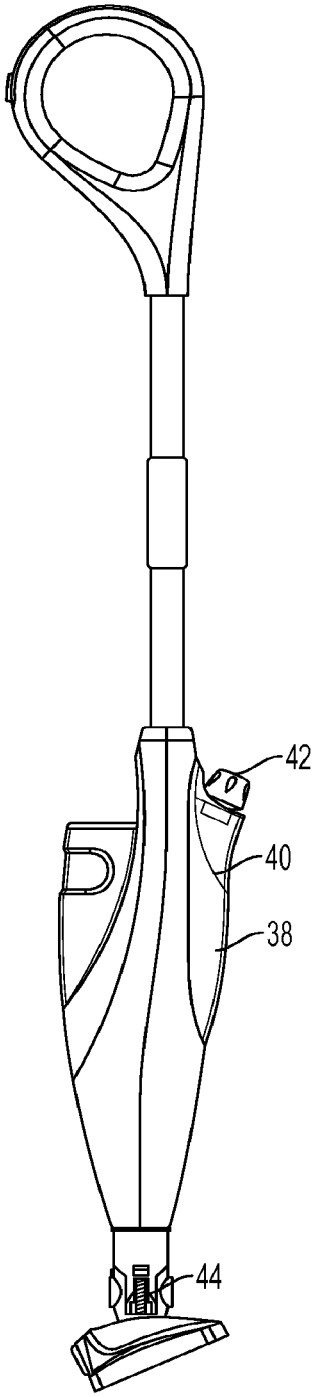
FIG. 3 is a side view of the steam cleaning appliance according to one embodiment of the invention.

As shown in FIG. 3, the rear side of the housing 22 includes a second liquid reservoir 38, which can hold water for delivery to the steam generating unit. The second liquid reservoir 38 is non-removable in the illustrated embodiment, though a removable reservoir may be used in other embodiments. In some embodiments, the water reservoir has a viewable fill-line 40. A reservoir cap 42 or flip-door may be included in some embodiments. Also shown in this figure is a conduit jacket 44 passing through the universal connector 16, which houses the first conduit and the second conduit.

Universal connector 16 may allow pivoting about two or more pivot axes. In some embodiments, a first pivot axis is horizontal and a second pivot axis is perpendicular to the first pivot axis (non-intersectingly perpendicular in some embodiments, and intersectingly perpendicular in some embodiments). The connector may include an interior volume that permits one or more flexible or non-flexible conduits to pass through the connector from the appliance body to the cleaning head. In some embodiments, the cleaning head is removable from the appliance body, and the connector provides a detachable connection point that allows the removal of the cleaning head from the body. In such embodiments, the connector also may include connectors which allow one or more fluid conduits to be separated so that the cleaning head can be removed from the body.

A connector other that a universal connector may be used to connect the cleaning head to the appliance body in some embodiments. For example, in some embodiments, a connector with a single pivot axis or a connector with a single swivel axis may be used.

In some embodiments, a single reservoir may be provided, and liquid from the reservoir may be directed to both the steam generating unit and the liquid applicator. As a result the same liquid may be used in the steam generating unit and with the liquid applicator. In some embodiments, a cleaning agent may be added to the liquid as it travels from the single reservoir to the liquid applicator such that the liquid present at the liquid applicator is different than the liquid arriving at the steam generating unit. For example, a reservoir of cleaning agent may dispense cleaning agent into the liquid as the liquid is delivered to the liquid applicator.

To generate steam, water from the second reservoir 38 is transferred to the steam generating unit 24. In some embodiments, an electric pump transfers water from the second reservoir 38 to the steam generating unit 24. In other embodiments, a manually actuable pump may be used to move water from the reservoir to the steam generating unit. In such embodiments, the pump may be configured such that movement of the handle during pushing and/or pulling of the cleaning appliance to move the cleaning head across the floor actuates the pump. For example pole 20 may move relative to cleaning head 14, and in doing so, move components of a manual pump to pump water to the steam generating unit 24. In some embodiments, this relative movement may be achieved by having the pole 20 move relative to housing 22.

In some embodiments, the water can be pumped by an electrically-powered pump (not shown) and the pump can be controlled to produce selected steam levels. In some embodiments, the steam appliance has three steam levels selectable by the user. For example, the pump may pump a controlled amount of water to the steam generating unit based on switch position selected by the user. In some embodiments, instead of delivering water to a heated boiler, the steam generating unit 24 may include a pressurized boiler, or any other suitable boiler type. The pressurized boiler may meter out the steam at selected levels.

Alternatively, a gravity feed system may be used, and the transfer of water may be controlled with a pinch valve or other type of valve. Additionally, the liquid in the second reservoir does not necessarily have to be pure water as the liquid may contain additives or other liquids. Further details regarding possible arrangements for moving water to the steam generating unit are discussed further below.

From the steam generating unit 24, a second conduit carries the steam to a steam outlet, which emits steam toward an upper surface of the steam-permeable pad 26. A portion or all of the steam permeates the pad and is applied to the floor. In some embodiments, the steam-permeable pad 26 may be a steam pocket where fabric substantially envelops a steam frame, in some cases providing multiple surfaces from which steam can emanate.

As discussed above, heating the cleaning solution prior to floor application can reduce cleaning time and/or effort. In some embodiments, the cleaning solution may be heated by a dedicated heating system, for example an electric resistance heater which heats the cleaning solution while in the reservoir. Or an in-line electric resistance heater may be used to heat the liquid as the liquid moves from the reservoir to the liquid applicator.

Figure 4:
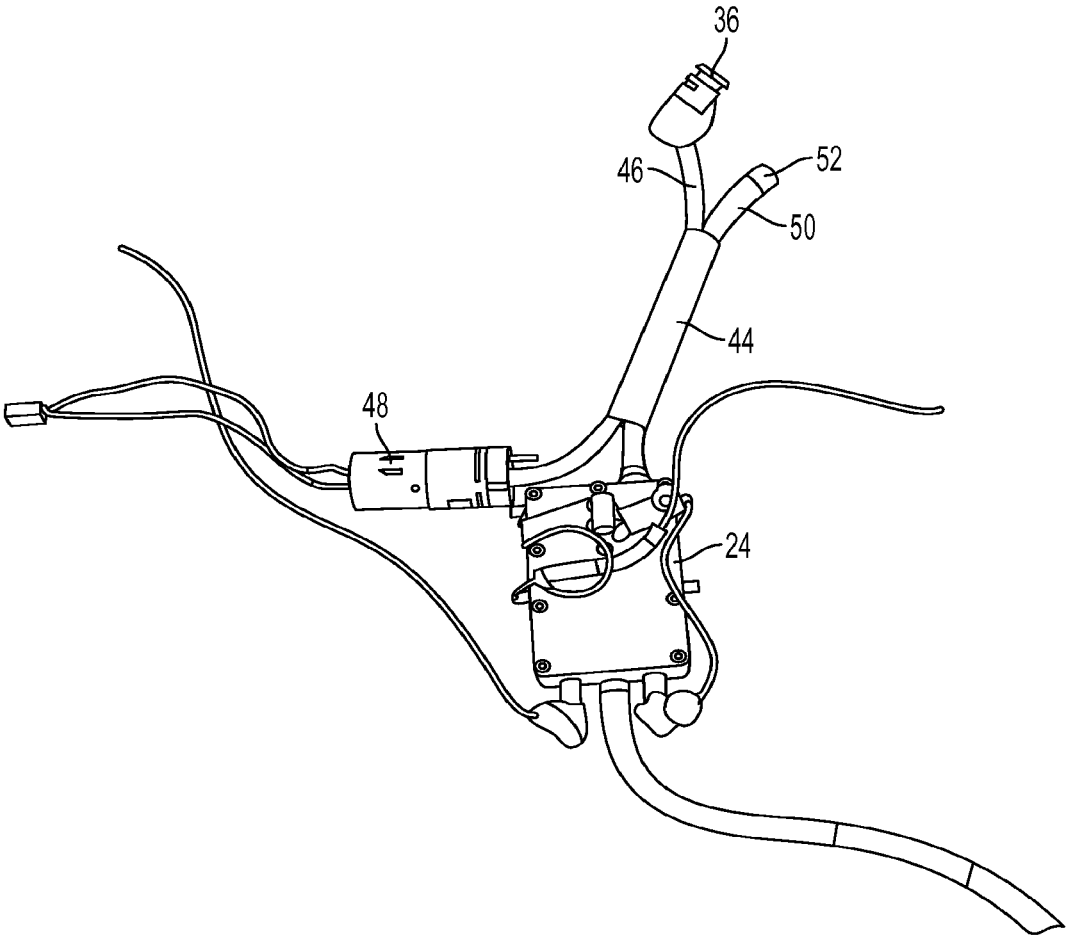
FIG. 4 shows a liquid heating arrangement according to one embodiment of the current invention.

Taking advantage of the heat generated by the steam generating unit, the cleaning solution may be heated by strategic positioning of the liquid conduit and/or reservoir relative to components of the steam system. By heating the cleaning solution while the solution remains contained, undiluted solution can be applied to areas to be cleaned. For example, in some embodiments, and as show in FIG. 4, the first conduit 46, which transports the cleaning solution from the first reservoir 32 to the liquid applicator 36 using a pump 48, is contained within thermally insulated jacket 44 along with the second conduit 50, which transports steam from the steam generating unit 24 to the steam outlet 52. In this embodiment, the heat from the steam in the second conduit 50 heats the cleaning solution in the first conduit 46 via heat transfer through the conduits. In another embodiment, the first conduit 46 containing the cleaning solution is placed in contact with or near the steam generating unit 24, or is placed through an integral part of the unit, such that the cleaning solution is heated by the steam generating unit 24. In some embodiments, all or a portion of first conduit 46 is made of a flexible tube. Other suitable materials may be used to form conduit 46, including thermally conductive materials such as various metals. Conduit 46 need not be one continuous conduit formed of a single material, but instead may include many portions. In some cases, conduit 46 may include components that are not shaped as a pipe or tube, but are still considered part of the conduit.

Figure 5:
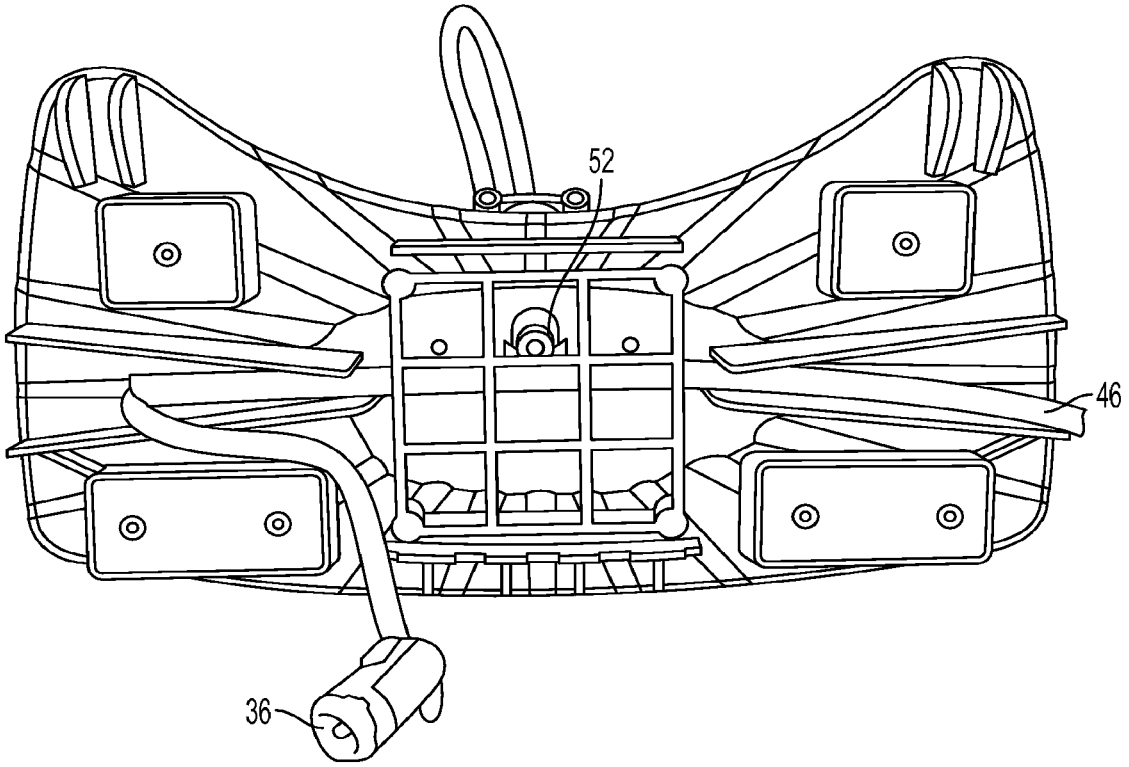
FIG. 5 is an underside view of a cleaning head according to one embodiment of the invention.

In some embodiments, as illustrated in FIG. 5, the first conduit 46 is placed on the underside surface of the cleaning head 14 within the path of the steam outlet 52, such that the steam emitted from the steam outlet 52 heats the cleaning solution traveling through the first conduit 46 to the steam liquid applicator 36.

In some embodiments, the appliance may have a mode where steam cannot be applied to the floor. In such an embodiment, the appliance may be battery powered while in this mode, and the power cord may be detached from the appliance (or not initially attached). The power cord can be reattached to the appliance at a later time if the user decides to resume steam cleaning. In some embodiments, when the user unplugs the power cord from the power outlet or detaches the power cord from the appliance at a power cord connector 54, as illustrated in FIG. 6, a controller automatically suspends and/or disables steam production and/or application.

While in a cleaning solution-only mode, the pole 20 of the appliance body 12 may automatically lock to prevent water from traveling into the steam generating unit 24 according to some embodiments. A lock 56 or other obstruction may be placed in an obstructing position when the steam generating unit 24 is not in a condition to generate steam. For example, removal of the power cord from the appliance, or unplugging the power cord from an outlet may de-energize a solenoid, resulting in a pin moving into a slot to prevent movement of the handle. In some embodiments, a temperature sensor is used to sense the steam-generating unit temperature, and if the sensed temperature is below a threshold temperature, the handle may be locked. In other embodiments, the appliance may be provided with a steam on/off switch, and when the steam on/off switch is in the off position, the handle is locked against movement. The lock 56 can be released when the user decides to resume steam cleaning. In some embodiments, the handle may not automatically lock when the steam generating unit 24 is turned off. Instead, the appliance may include a manually-activated lock which the user engages to prevent handle movement.

In some embodiments, the pole may be locked relative to the body via a plunger that extends through an opening in the pole. For example, a plunger 57 may be coupled to housing 22 When the plunger is pulled inwardly, pole 20 is permitted to move up and down relative to the housing. When the plunger extends outwardly through an opening 59 in pole 20, the pole is prevented from movement relative to the housing. The plunger may be moved with a solenoid that responds to a controller or other arrangement to lock the pole when the steam system is not in use. For example, a microswitch may be present in the power cord connection unit, and the state of the microswitch depends on the presence of the power cord.

Figure 6:
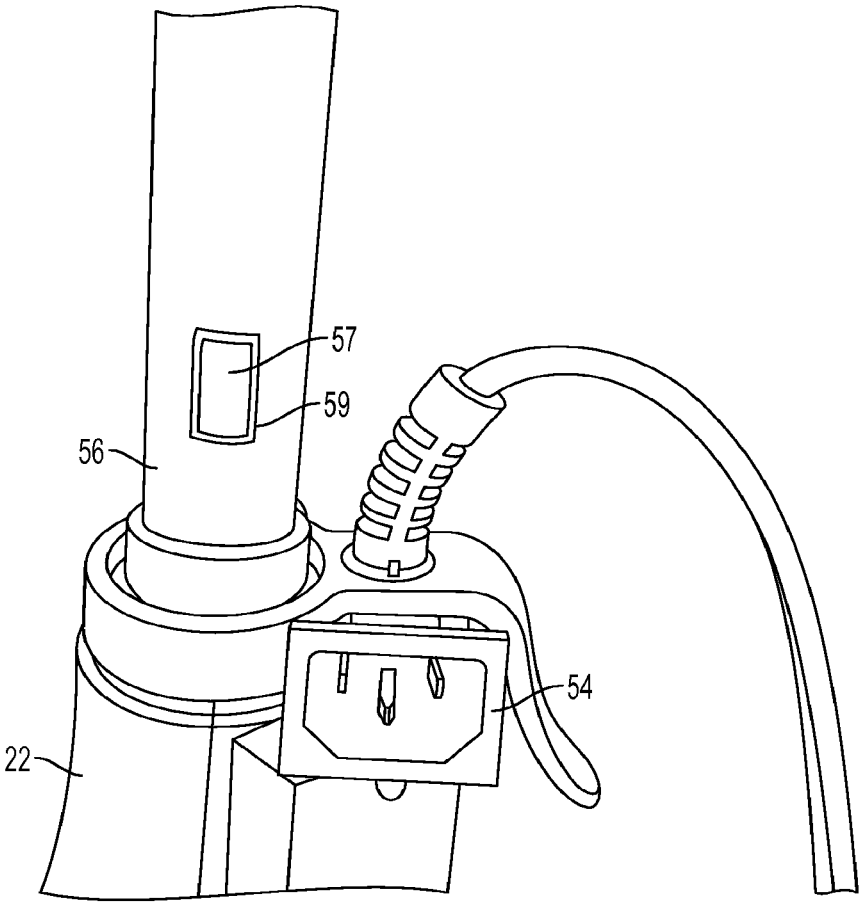
FIG. 6 is a side view a liquid transfer lock according to one embodiment of the invention.

The plunger may be positioned as shown in FIG. 6, or the plunger may extend horizontally (when the pole is in the upright position) from the power cord connection unit.

In some embodiments, instead of a plunger, a locking pin or other device may be inserted into the pole to lock the pole' s movement relative to the housing. The locking pin may be associated with a device that needs to be moved to permit removal of the power cord. In this manner, when the device is moved to allow removal of the power cord, the locking pin moves into an obstruction position to prevent pole movement.

In some embodiments, the delivery of water from the reservoir 38 to the steam generating unit 24 is performed in response to movement of the appliance rather than movement of the handle relative to the body or cleaning head. For example, a motion sensor or an acceleration sensor may be included in the cleaning head, body, handle, or other suitable location to sense preset levels or types of movements. A controller then may signal a pump to operate, or signal a valve to open to deliver water to the steam generating unit 24. In such embodiments, the controller also may receive a signal that the steam function is not desired, or that the steam generating unit 24 is not operating, or that the steam generating unit 24 is not at a sufficient temperature to create steam, and the controller may be configured to not signal delivery of water to the steam generating unit under such circumstances.

While the embodiments illustrated herein position the reservoir 38 and steam generating unit 24 on the body of the appliance, some or all of these components may be positioned on or within the cleaning head 14, or in any suitable location or position.

Figure 7:
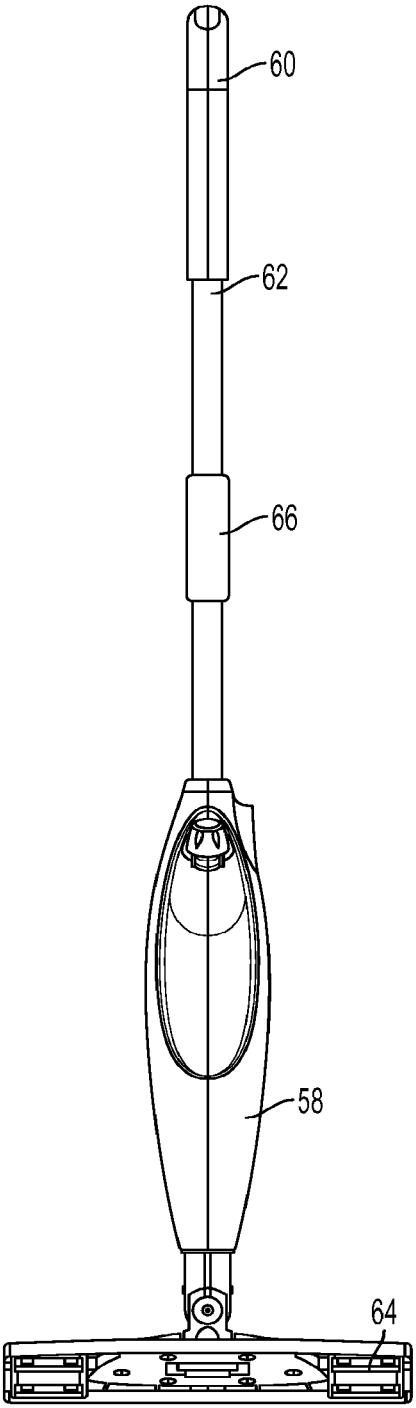
FIG. 7 is a rear view of the steam cleaning appliance according to one embodiment of the invention.

Turning to FIG. 7, the rear side of the housing has a battery compartment 58 to hold batteries that power the pump 48 for the cleaning solution when a user disconnects the power cord from the power cord connector 54. The batteries also may power the pole lock and/or any controller(s) included on the steam appliance. The batteries may be rechargeable or disposable.

An anti-slide layer 60 may be included on the handle 18 to improve user control of the steam cleaning appliance 10. A cable wrap 62 also may be attached to the rear side of the handle 18 to allow the user to secure the power cord while in the cleaning solution-only mode or while storing the steam cleaning appliance 10 after use. In another embodiment, a cable wrap may be attached to the rear side of the pole 20 or to the rear side of the housing 22.

As discussed above, steam-permeable pads 26 may be removably attached to the cleaning head. The steam-permeable pad 26 may be made of microfiber, terry-cloth, cotton, polyester, any combination thereof, or any other suitable material. The steam-permeable pad 26 also may include a tab or section that extends beyond the perimeter of the cleaning head 14 when the steam-permeable pad 26 is attached thereto, thereby allowing a user to remove the pad from the steam cleaning appliance by only touching an unused portion of the pad. For example, the user can step on the tab or other extended portion and pull up on the appliance to remove the pad. Or, the user can lift up the appliance, grasp the tab with his or her hand, and remove the pad. In other embodiments, the pad 26 is larger than the cleaning head 14.

The pad may include an extended portion that is arranged to extend rearwardly beyond a rear edge of the cleaning head when mounted to the cleaning head. In this manner, the extended portion can aid with drying any moisture left by the spraying and/or steaming.

In some embodiments, a cleaning sheet 28 is provided as a pad which can be used when only the cleaning liquid is being applied. For example, a sheet having an absorbent layer may be attached to the cleaning head 14 in any suitable manner. The sheet 28 may be a woven or non-woven fabric, or other suitable material. The material may have any suitable density, for example a density of between 0.01 grams per $cm^3$ and 0.2 grams per $cm^3$, though any density may be used. The density of the material may be constant throughout the pad, or may vary through the pad thickness and/or along the width and/or length of the pad. In some embodiments, a disposable sheet may be provided for use with the cleaning liquid. A washable and reusable sheet may be provided, for example, a sheet made of microfiber.

Figure 11:
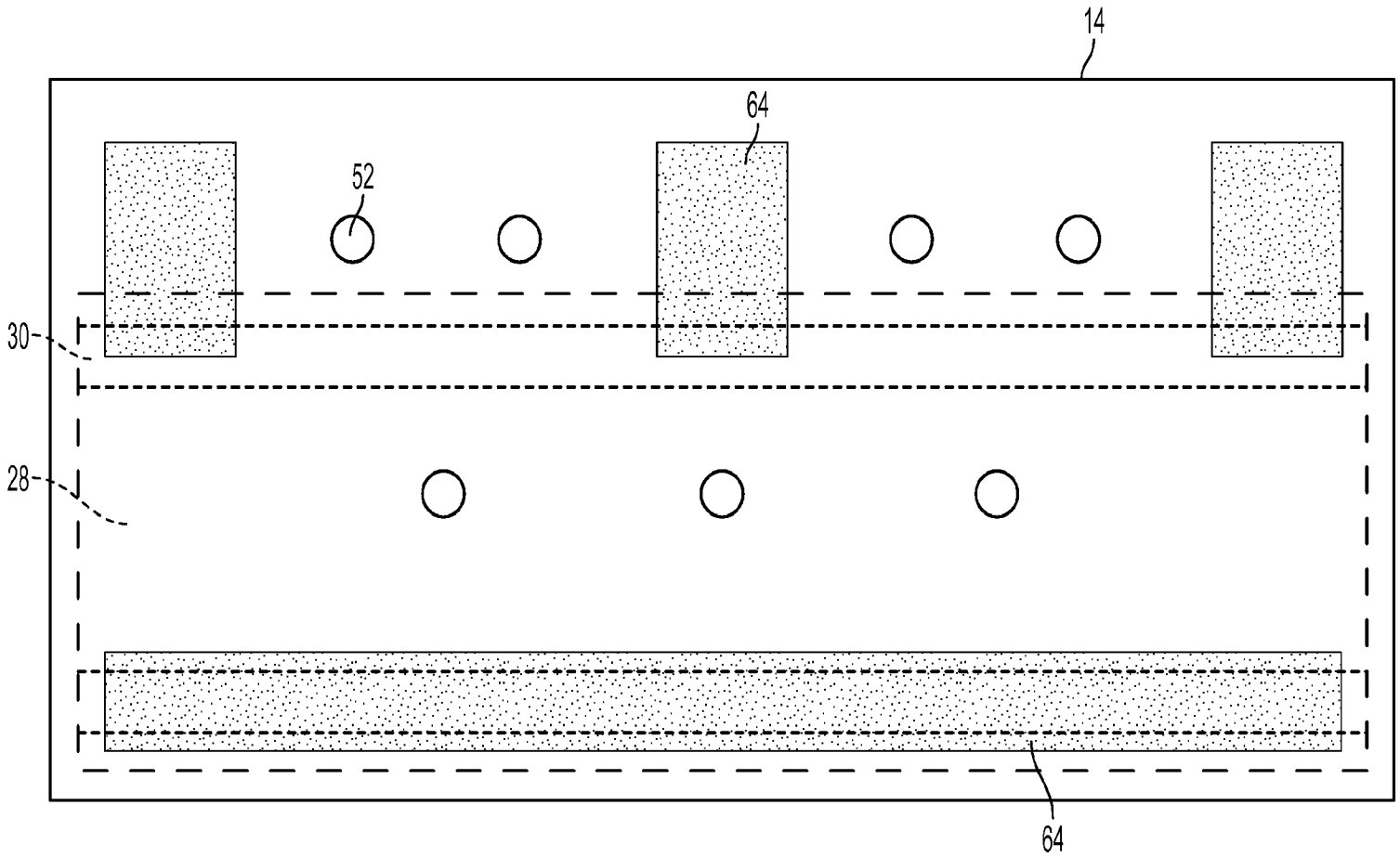
FIG. 11 is a schematic view of the underside of a cleaning head including a pad according to one embodiment of the invention.

Cleaning sheet 28 may be used when steam is being applied as well. The cleaning sheet 26 may be steam-permeable or steam-impermeable. If the sheet is steam impermeable, it may be sized relative to the cleaning head 14 to permit steam to be applied to the floor around the edge of the sheet. In one such embodiment, as shown in FIG. 11, the underside of the cleaning head 14 has fastening materials 64 to which a corresponding attachment layer 30 on the disposable impermeable pad attaches. The cleaning head 14 also may be configured in this embodiment such that the steam outlets 52 are positioned outside the edge of the pad 28. In one embodiment, a gap is provide between the edge of the pad 28 and the front of the cleaning head 14. The cleaning head and pad may be configured such that a gap between the edge of the pad 28 and the cleaning head 14 is on the side of the cleaning head 14 or at the back of the cleaning head 14. In some embodiments, the cleaning sheets 28 are steam-permeable and have no holes or openings in the pad 28. The cleaning sheets also may have no gaps between the edge of the pad 28 and the cleaning head 14, though in some embodiments, such gaps are present. Various pads may be provided which include a scrubbing material in combination with absorbent material. For example, a strip of abrasive material may be included on the floor-facing side of the pad, and be made of polyester, polypropylene, or other suitable material.

A backing layer may be included on the pad to provide structural stability. An attachment layer may be included, such as a layer having hook and loop fastening material for attachment to complementary hook and loop fastening material 64 on the cleaning head 14.

To clean stubborn stains or spills, the user may wish to press downwardly on the cleaning to increase friction between the pad and the floor. By providing an additional hand grip at a location between the handle and the housing, the user can comfortably grasp the appliance with two hands to apply the extra force. For example, a grip 66, shown in FIG. 7, may be positioned on pole 20. The grip 66 may be formed with foam, rubber, plastic, or any other suitable material or combination of materials. In some embodiments, the position of the grip may be adjustable so that the user can place the grip at a location that is comfortable for their height and arm length. Additionally, the grip 66 may be contoured to receive a user's hand in a certain orientation. In some embodiments, the grip 66 may be removable, and the user may select which grip is attached from among a set of different grips.

Figure 8:
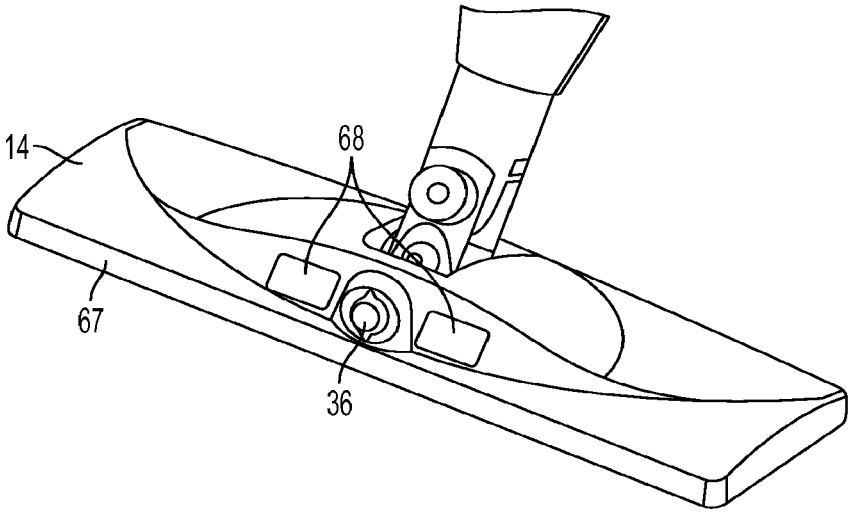
FIG. 8 is a perspective view of a cleaning head including scrubbing pads according to one embodiment of the invention.

For stubborn stains or spills, a user may also use scrubbing pads 68 located on either side of the liquid applicator 36 on the cleaning head 14, as shown in FIG. 8. The pads 68 may be permanently affixed to the cleaning head 14 or removably attachable using hook and loop fastening material that attaches to complementary hook and loop fastening material on the cleaning head 14. To clean a stubborn stain with these pads 68, the user may invert the cleaning head 14 and press downwardly on the cleaning appliance to create friction between the pad and the floor. In some embodiments, a scrubbing pad may be positioned along the entirety or a portion of a front face 67 of the cleaning head 14.

Figure 9:
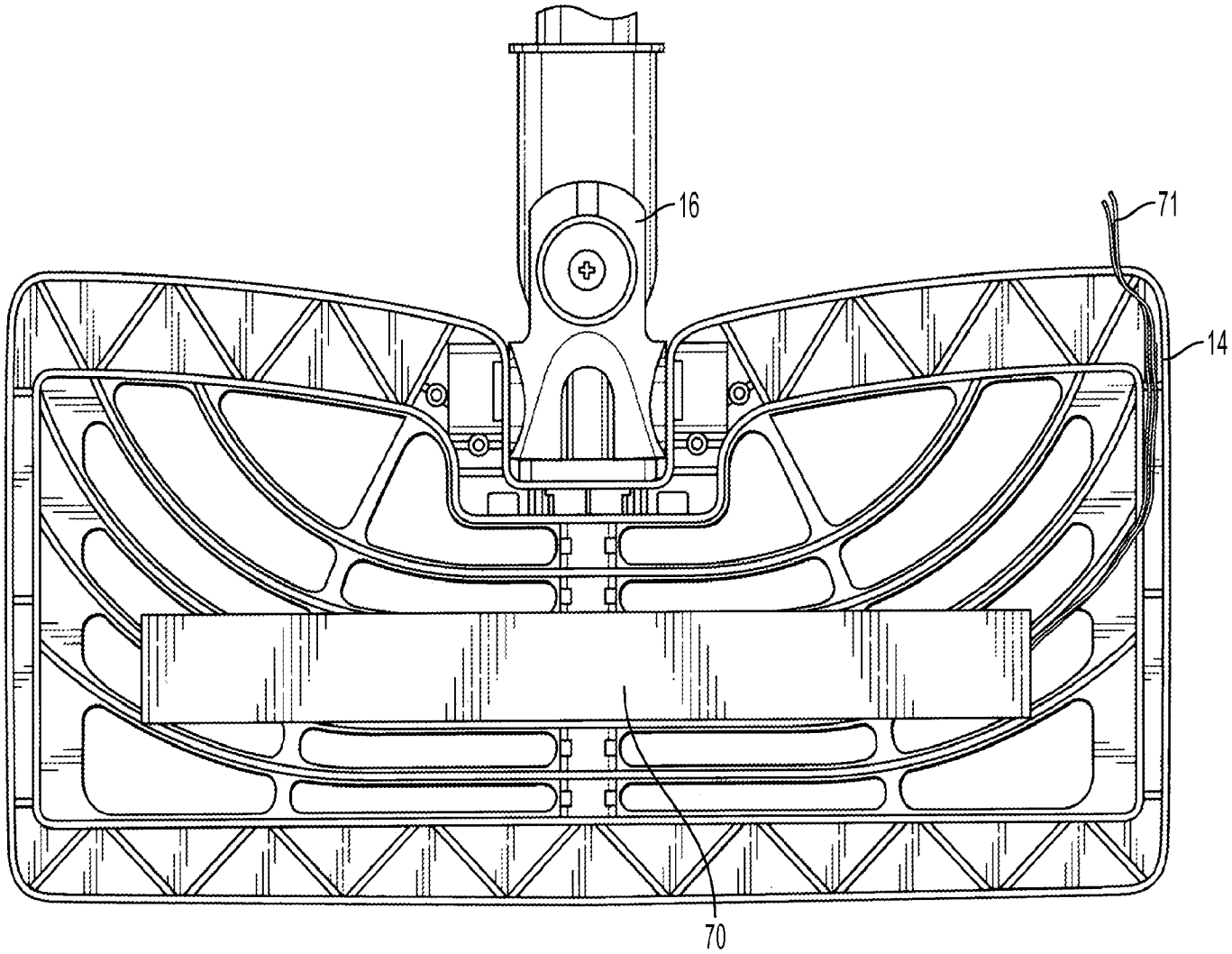
FIG. 9 is a bottom view of a cleaning head including a heating element according to one embodiment of the invention.

In another embodiment, the cleaning head 14 may include a heating element 70 coupled to the underside of the cleaning head 14, as shown in FIG. 9. The heating element 70 may be a heating element capable of increasing the temperature of the cleaning head 14 as well as the temperature of the pad to deliver enhanced cleaning performance. Further, the heat from the heating element 70 may be provided to one side or to both side of the cleaning head 14.

In some embodiments, the heating element 70 may be capable of providing from about 90 to 130 W of power. In other embodiments, the heating element 70 may have an operating temperature of from about 135 to 150 degrees Celsius. Although shown as substantially rectangular, the heating element 70 may also take on a plurality of polygonal shapes, including circular and square, among others. The heating element 70 may also be embedded about the exterior portions of the cleaning head 14.

Power may be provided to the heating element 70 via an electrical outlet 71 that may be routed through the universal connector 16. Power for the heating element 70 may also be provided by a battery (not shown). The cleaning head 14 or the steam cleaning appliance 10 also may include an on/off trigger or a motion sensor for disabling the heating element 70 when the steam appliance is stationary or not being used. In another embodiment, the user may manually turn on/off the heating element 70 as necessary depending on the cleaning performance of the pad on the floor surface.

Figure 10:
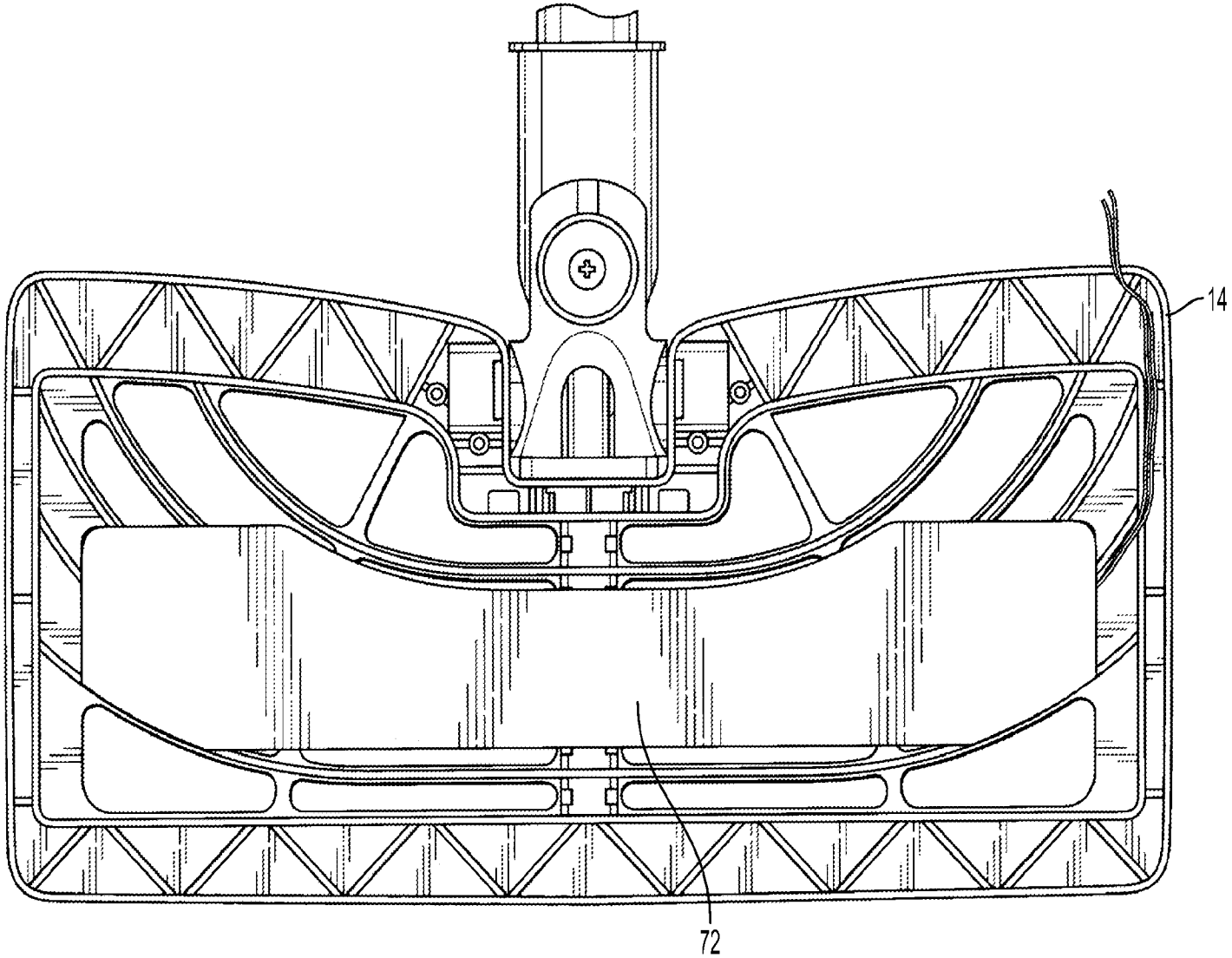
FIG. 10 is a bottom view of a cleaning head including a heating element according to one embodiment of the invention.

Turning to FIG. 10, a top-down view of the cleaning head 14 according to another embodiment is shown. In this embodiment, the heating element 72 is a heating plate that may be attached to the cleaning head 14 using glue or other suitable fasteners. In some embodiments, the heating element 72 may be embedded in the cleaning head 14 via alternative fastening mechanisms, including nuts, bolts, rivets, or another suitable fastening mechanism. In other embodiments, the heating element 72 may be integrally formed with the cleaning head 14, e.g., the cleaning head 14 and the heating element 72 may both be made of the same material such as aluminum, copper, or another suitable metal or other suitable material.

In operation, the heat from the heating element 72 allows a stain to be removed easier from the floor surface. The additional heat may be carried by the pad for making contact with the stain, the increased temperature allowing the stain to be easier dissolved or dissociated from the floor surface.

Figure 12:
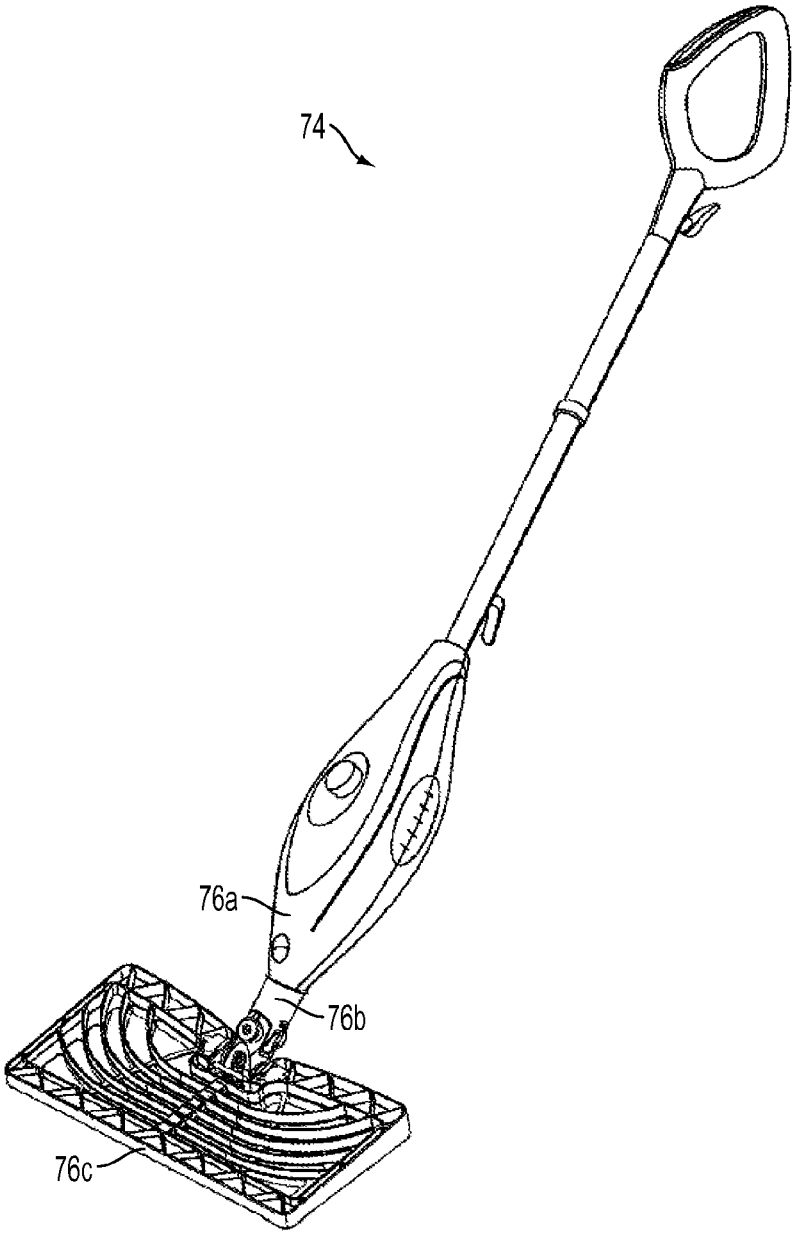
FIG. 12 is a perspective view of a steam cleaning appliance according to one embodiment of the invention.

Although the embodiments described thus far have included a cleaning head that emits steam from one side, it should be appreciated that embodiments may include cleaning heads which emit steam from two or more sides. For example, a steam pocket mop 74, as shown in FIG. 12 may be used. In such embodiments (and in embodiments previously described), a liquid applicator (76*a*, 76*b*, 76*c*) may be located at one or more positions on the appliance, for example, on the body, the universal connector, and/or on the front-facing surface of the cleaning head. Although three liquid applicators are shown in this embodiment, only one or only two liquid applicators may be provided in some embodiments, or more than three applicators may be provided in other embodiments.

Figure 13:
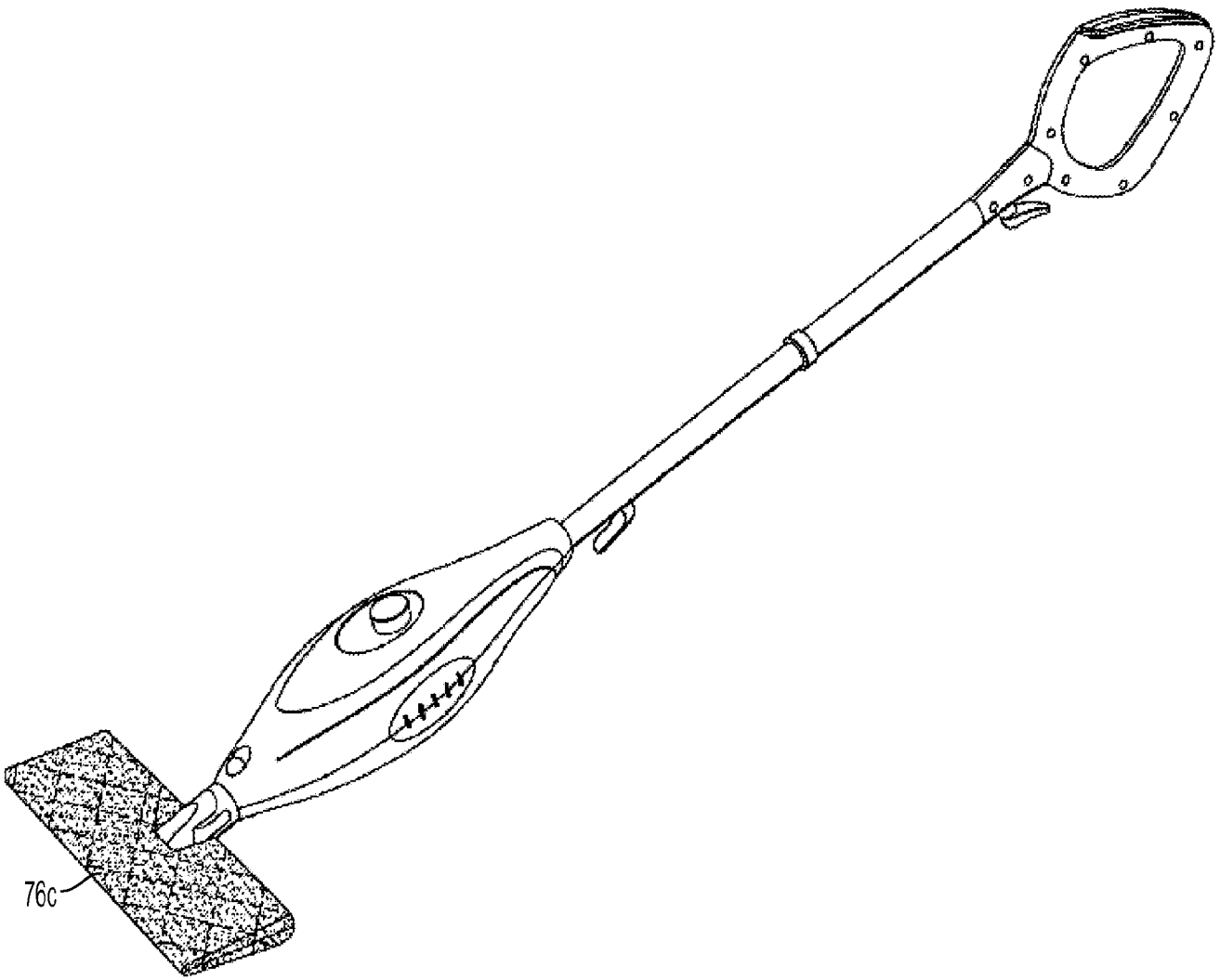
FIG. 13 is a perspective view of a steam cleaning appliance according to one embodiment of the invention.

In the embodiments where a liquid applicator is located on the front-facing surface of the cleaning head, the steam pocket fabric may have an opening so that the liquid applicator 76*c* is not covered by the fabric, as shown in FIG. 13. The conduit for the liquid applicator may pass through the cleaning head as part of a system of heating the liquid to be ejected from the liquid applicator. Other suitable arrangements for two-sided steam appliances may also be employed.

Figure 14:
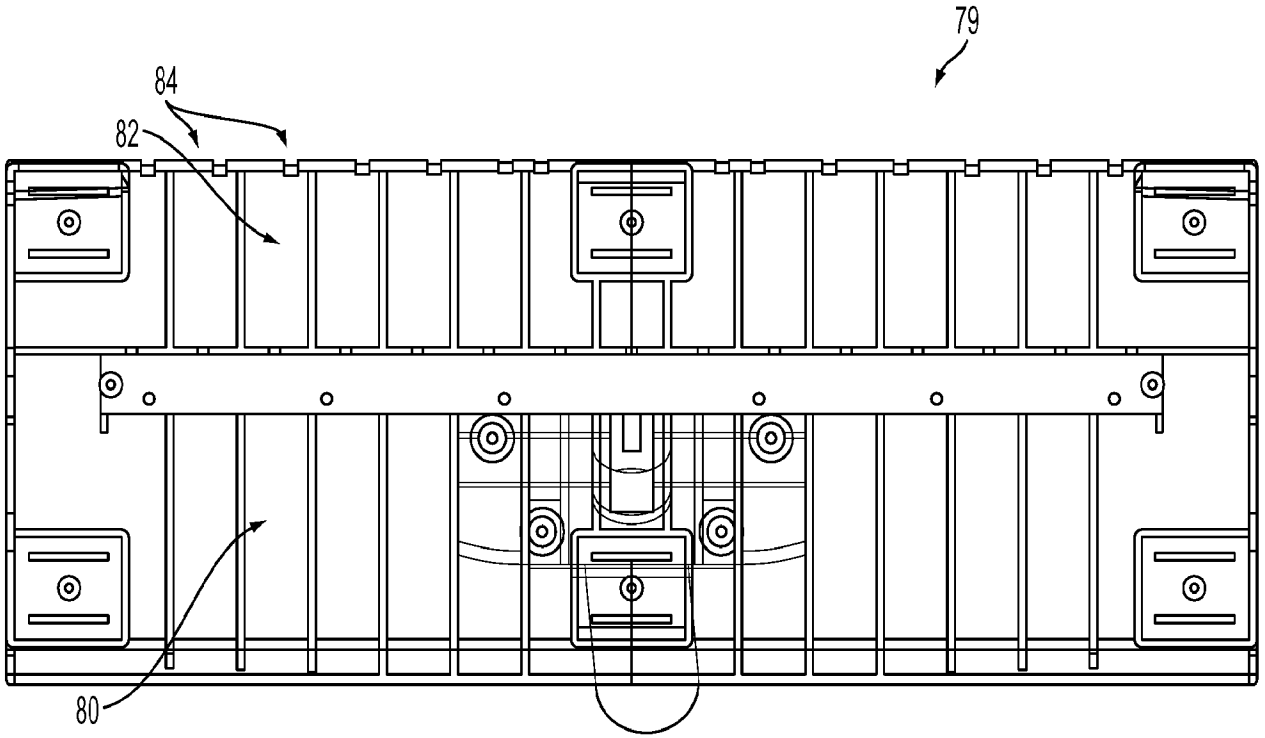
FIG. 14 is a bottom view of a cleaning head according to one embodiment.

FIG. 14 shows an underside of a cleaning head 79 with two different steam zones. A reduced steam zone 80 is positioned at a rear portion of the cleaning head, and a regular steam zone is positioned at a front portion of the cleaning head. In this manner, a pad mounted on the cleaning head may be drier along the rear portion. Such an arrangement may limit or eliminate the amount of moisture left on the floor after the pad passes over the floor. In some embodiments, reduced steam zone 80 may emit no steam. A user may have the option to choose whether steam zone 80 emits steam in some embodiments.

Steam vents 84 may be positioned at the front of the cleaning head, and additional vents may be positioned on other edges of the cleaning head. The steam vents may direct steam toward the floor.

Figure 15:
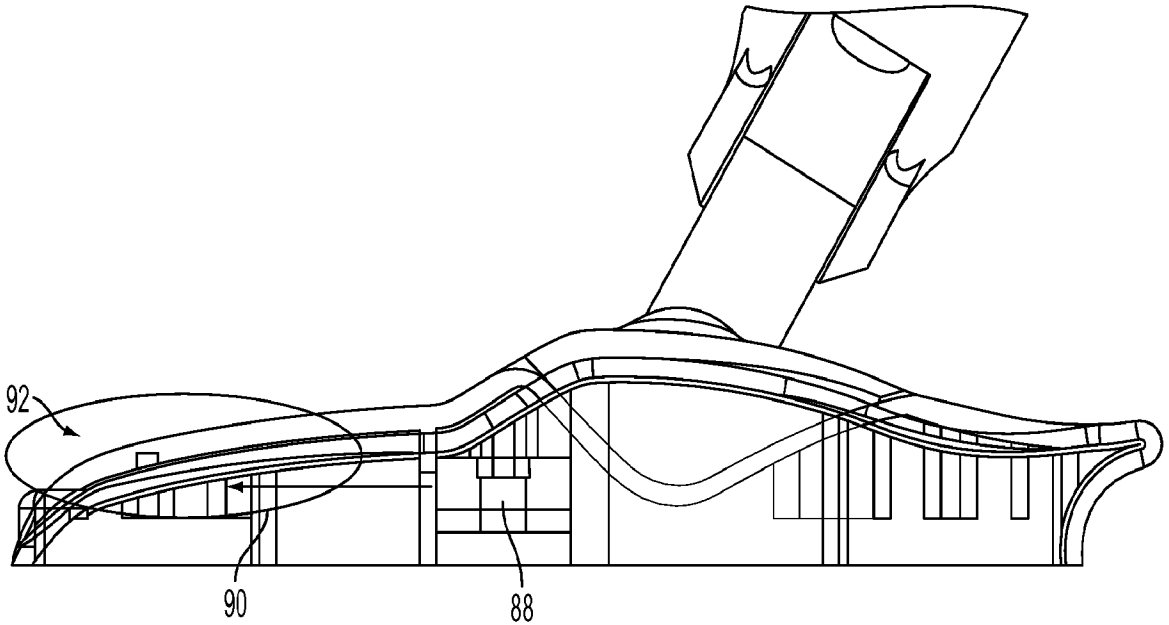
FIG. 15 is a side view of the cleaning head of FIG. 14.

In FIG. 15, a steam diffuser 88 is shown directing steam toward a front of the cleaning head along a steam path 90. An upper, front portion 92 of the cleaning head may be curved to facilitate directing the steam to the vents at the front of the cleaning head.

Figure 16:
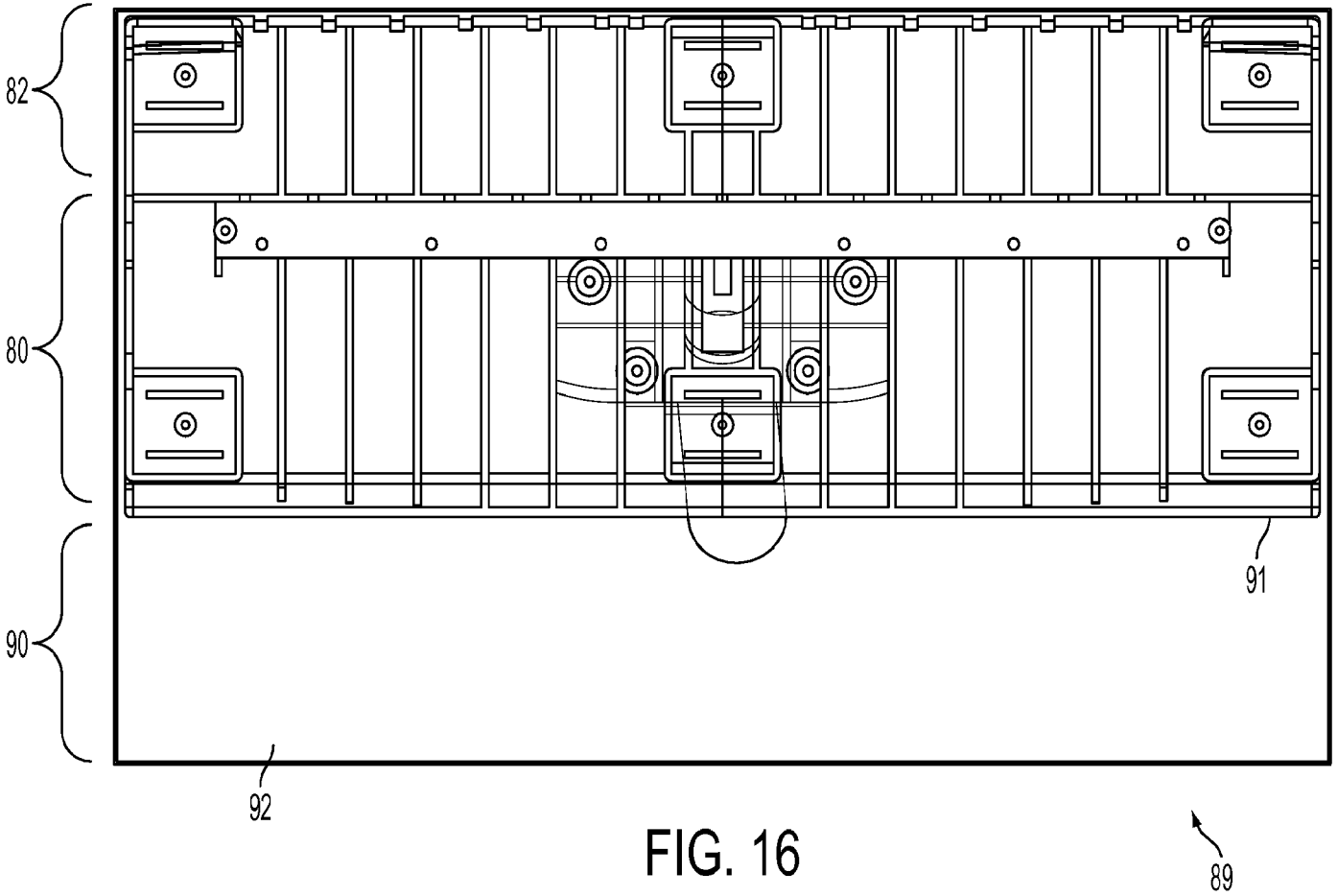
FIG. 16 is a bottom view of a pad mounted to a cleaning frame according to one embodiment.

A pad 89 may include a rearwardly extending region 92 which extends beyond a rear edge 91 of the cleaning head, as shown in FIG. 16. Extended region 92 can absorb moisture remaining from the spray and/or steam operations. By providing additional surface area to absorb and pick up contaminants, extended region 92 also may extend the life of a pad and/or increase the time between pad cleanings.

Figure 17:
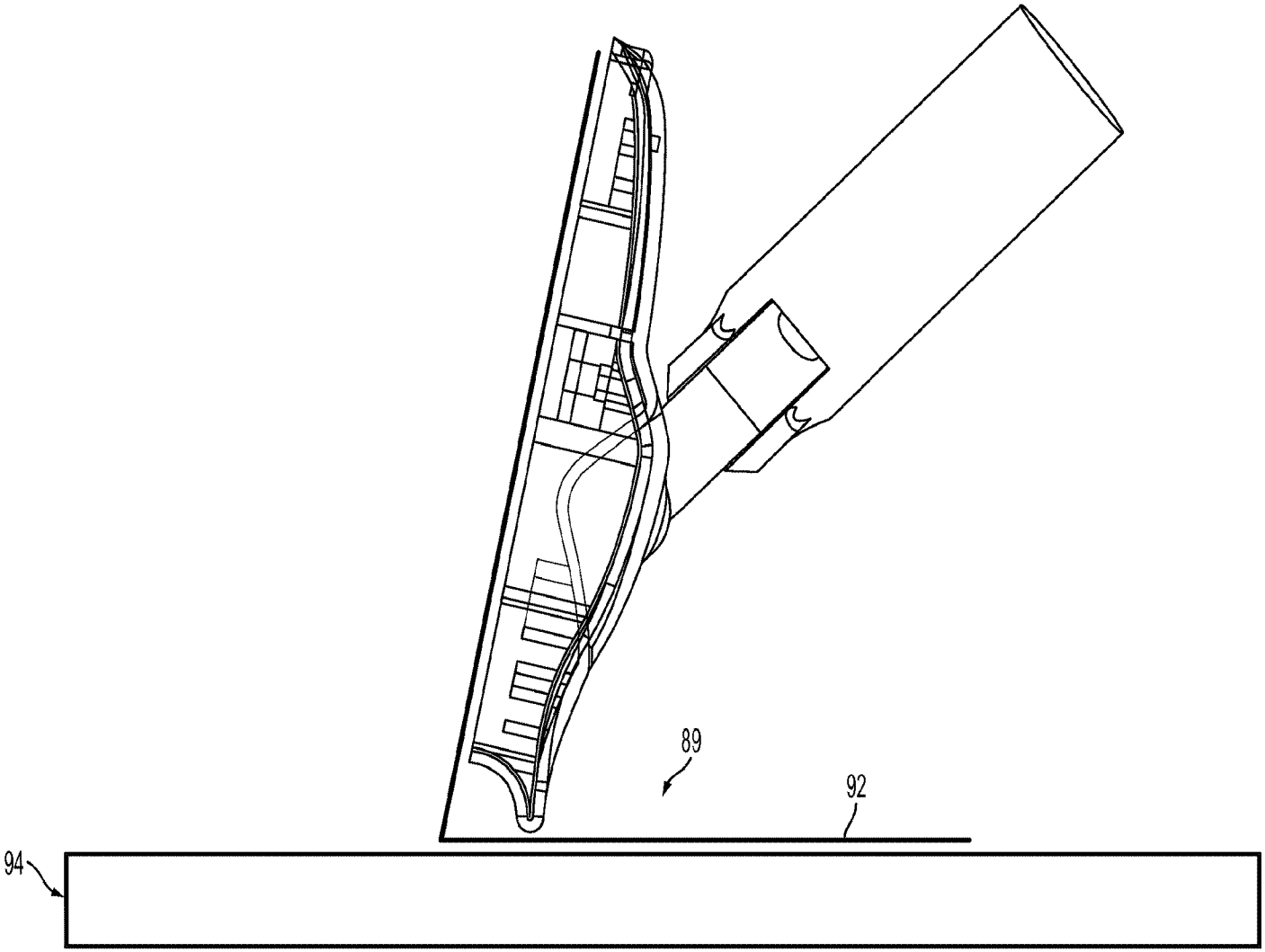
FIG. 17 is a side view of the cleaning head and pad in a scrubbing position according to one embodiment.

FIG. 17 shows one embodiment where the cleaning head is pivoted upwardly and the pad is bent. Rearwardly extending portion 92 of the pad remains in contact with floor 94. A user can step on the extended portion 92 to scrub areas of the floor.

For purposes herein, the term "floor" is meant to include various types of floors, such as hardwood floors, linoleum floors, carpets, and any other floor surface amenable to cleaning. It should be appreciated that aspects of the embodiments disclosed herein may be employed on cleaning appliances which are capable of cleaning surfaces other than floors, such as countertops, walls, ceilings, oven hoods, or other surfaces.

For purposes herein, the terms "connect", "connected", "connection", "attach", "attached" and "attachment" refer to direct connections and attachments, indirect connections and attachments, and operative connections and attachments.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A steam cleaning appliance for cleaning floors comprising:

an appliance body;

a handle attached to the appliance body;

a liquid applicator to apply a first liquid to a floor;

a steam source to generate steam; and a cleaning head to apply steam to the floor; wherein movement of the handle in a forward and/or backward motion to move the cleaning head on the floor operates a liquid delivery system to deliver a second liquid to the steam source; and further comprising a controller and a lock configured to automatically prevent delivery of the second liquid to the steam source in response to the steam cleaning appliance being disconnected from a power source.

2. A steam cleaning appliance as in claim 1, further comprising:

a first reservoir to hold the first liquid, the liquid applicator being in communication with the first reservoir; and a second reservoir to hold the second liquid, the steam source being in communication with the second reservoir.

3. A steam cleaning appliance as in claim 2, wherein:

the handle is movably attached to the appliance body;

movement of the handle in a forward and/or backward motion to move the cleaning head results in a movement of the handle relative to the cleaning head, which movement pumps the second liquid from the second reservoir to the steam source; and the controller comprises an obstruction which prevents movement of the handle relative to the cleaning head.

4. A steam cleaning appliance as in claim 1, wherein the first liquid is different from the second liquid.

5. A steam cleaning appliance as in claim 1, further comprising a steam-permeable cleaning pad mounted to the cleaning head, wherein the cleaning head is configured to apply steam to the floor through the pad.

6. A steam cleaning appliance as in claim 1, wherein a solenoid is de-energized to automatically prevent delivery of the second liquid to the steam source in response to the steam cleaning appliance being disconnected from the power source.

7. A steam cleaning appliance as in claim 1, wherein the controller is configured to automatically prevent delivery of the second liquid to the steam source in response to a temperature sensor detecting a sensed temperature of the steam source being below a threshold temperature.

8. A steam cleaning appliance as in claim 1, wherein the liquid applicator includes an electric pump.

9. A steam cleaning appliance for cleaning floors comprising:

an appliance body;

a handle attached to the appliance body;

a liquid applicator to apply a first liquid to a floor;

a steam source to generate steam; and a cleaning head to apply steam to the floor; wherein movement of the handle in a forward and/or backward motion to move the cleaning head on the floor operates a liquid delivery system to deliver a second liquid to the steam source; and further comprising a controller and a lock configured to automatically prevent delivery of the second liquid to the steam source in response to the steam cleaning appliance being disconnected from a power source and/or a temperature sensor detecting a sensed temperature of the steam source being below a threshold temperature, wherein the lock is configured to prevent pushing and/or pulling movement of the handle relative to the appliance body and/or cleaning head in response to the steam cleaning appliance being disconnected from the power source and/or the temperature sensor detecting the sensed temperature of the steam source being below the threshold temperature.

10. A steam cleaning appliance as in claim 9, wherein the lock includes a plunger configured to be received in an opening to prevent pushing and/or pulling movement of the handle relative to the appliance body and/or cleaning head in response to the steam cleaning appliance being disconnected from the power source and/or the temperature sensor detecting the sensed temperature of the steam source being below the threshold temperature.

11. A steam cleaning appliance comprising:

a handle;

a liquid applicator fluidly coupled to a first reservoir and configured to dispense a first liquid;

a steam generator fluidly coupled to a second reservoir and configured to generate steam;

a cleaning head to dispense steam from the steam generator;

a manually actuable pump to move a second liquid from the second reservoir to the steam generator in response to movement of the handle during pushing and/or pulling of the steam cleaning appliance; and a controller and a lock configured to automatically prevent delivery of the second liquid to the steam source in response to the steam cleaning appliance being disconnected from a power source.

12. A steam cleaning appliance as in claim 11 wherein a solenoid is de-energized to automatically prevent delivery of the second liquid to the steam source in response to the steam cleaning appliance being disconnected from the power source.

13. A steam cleaning appliance as in claim 11, wherein the controller is configured to automatically prevent delivery of the second liquid to the steam source in response to a temperature sensor detecting a sensed temperature of the steam source being below a threshold temperature.

14. A steam cleaning appliance as in claim 11, wherein the liquid applicator includes an electric pump.

15. A steam cleaning appliance comprising:

a handle;

a liquid applicator fluidly coupled to a first reservoir and configured to dispense a first liquid;

a steam generator fluidly coupled to a second reservoir and configured to generate steam;

a cleaning head to dispense steam from the steam generator;

a manually actuable pump to move a second liquid from the second reservoir to the steam generator in response to movement of the handle during pushing and/or pulling of the steam cleaning appliance; and a controller and a lock configured to automatically prevent delivery of the second liquid to the steam source in response to the steam cleaning appliance being disconnected from a power source and/or a temperature sensor detecting a sensed temperature of the steam source being below a threshold temperature, wherein the lock is configured to prevent pushing and/or pulling movement of the handle in response to the steam cleaning appliance being disconnected from the power source and/or the temperature sensor detecting the sensed temperature of the steam source being below the threshold temperature.

16. A steam cleaning appliance as in claim 15, wherein the lock includes a plunger configured to be received in an opening to prevent pushing and/or pulling movement of the handle in response to the steam cleaning appliance being disconnected from the power source and/or the temperature sensor detecting the sensed temperature of the steam source being below the threshold temperature.

* * * * *